United States Patent [19]

Bushey et al.

[11] Patent Number: 4,673,213

[45] Date of Patent: Jun. 16, 1987

[54] POSTURE ALIGNMENT SEAT SHELL

[76] Inventors: Richard D. Bushey, 3521 16th Ave., Kenosha, Wis. 53140; Dennis J. Bushey, 833 Teutonia, Burlington, Wis. 53105

[21] Appl. No.: 826,302

[22] Filed: Feb. 5, 1986

[51] Int. Cl.[4] ..... A47C 3/00

[52] U.S. Cl. ..... 297/284; 297/250; 297/230; 297/396; 297/380

[58] Field of Search ..... 297/284, 456, 380, 381, 297/391, 396, 230, 231, 250

[56] References Cited

U.S. PATENT DOCUMENTS

| | | | |
|---|---|---|---|
| 2,557,874 | 6/1951 | Kailenta | 297/230 X |
| 2,828,810 | 8/1958 | Banecki et al. | 297/396 |
| 2,946,374 | 7/1960 | Dickey | 297/456 |
| 3,093,407 | 6/1963 | Wilson | 297/230 |
| 3,220,767 | 11/1965 | Hendrickson | 297/457 X |
| 3,220,769 | 11/1965 | Regan | 297/457 |
| 3,419,309 | 12/1968 | Smith | 297/456 |
| 3,454,302 | 7/1969 | Radford | 297/396 |
| 3,517,963 | 6/1970 | Woods et al. | 297/456 X |
| 3,941,418 | 3/1976 | Bernard | 297/456 |
| 4,164,356 | 8/1979 | Knight | 297/456 |

FOREIGN PATENT DOCUMENTS

| | | | |
|---|---|---|---|
| 590697 | 7/1947 | United Kingdom | 297/381 |

*Primary Examiner*—Francis K. Zugel

*Attorney, Agent, or Firm*—John C. Shepard

[57] ABSTRACT

A posture alignment seat shell for supporting and passively restraining a person seated therein includes a horizontal seat portion and an upstanding back portion formed from resilient material to define a one-piece unit. The upstanding back portion includes a lower back part connected to the seat portion, an upper back part above the lower back part and slanting forwardly thereform, and lateral side parts at opposite sides of the upstanding portion extending forwardly therefrom to prevent side movement of a person sitting thereon. The shell includes flexible strap means for pulling the upstanding back portion downward relative to the seat portion and adjusting the angular position of the back portion. The shell further includes strap means for securing the shell to a chair and strap means for pulling the top segment of the upper part downward and selectively adjusting the height thereof. The shell has non-rigid internal and external strap means to distribute pressure created by the adjusting strap means and prevent tearing of the resilient shell material.

13 Claims, 14 Drawing Figures

POSTURE ALIGNMENT SEAT SHELL

BACKGROUND OF THE INVENTION

1. Technical Field

This invention relates generally to seat cushions and, more particularly, to an adjustable seat shell for supporting a person sitting therein in proper posture.

2. Background Art

In the prior art, many attempts have been made to provide seating which enables a person who has impaired mobility to sit in a chair in an upright or slightly inclined position. These persons also require proper positioning in the chair with support being provided to hold their heads and to correctly locate the cervical and lumbar sections of their backs. Thus, it is important that a patient be supported so that they are upright and stable with the patient being limited in his movement in both vertical and side to side directions.

Typically, a patient is physically restrained by straps or barriers in wheel chairs, geriatric chairs and other chairs having seats and backs so that they do not slide down or forward in the chair and do not sag or fall to the side of the chair. Generally, these devices are uncomfortable and often place pressure at specific points on the patient. Further, the patient is unnecessarily limited in his movements while performing everyday activities. Thus, these are not highly desirable solutions to the problems presented.

Many attempts have also been made to provide chairs or sitting devices of special design to accommodate patients having particular needs or requirements. However, in addition to the fact that these devices and chairs are limited to the particular use for which they were designed, they are often expensive and heavy, and they are difficult to use, adjust and clean.

SUMMARY OF THE INVENTION

The present invention is directed to overcoming one or more of the problems as set forth above.

According to the present invention, a seat shell for supporting and passively restraining a person seated therein includes a horizontal seat portion and an upstanding back portion formed from deformable resilient material into a single, one-piece unit.

In an exemplary embodiment of the invention, the shell includes a flexible adjusting strap for pulling the back portion downward to adjust the angular position of the back portion relative to the seat portion so as to selectively adjust the support provided to the person's upper and lower back.

In another exemplary embodiment of the invention, the upstanding back portion includes a lower back part connected to the seat portion, an upper back part above the lower back part and slanting forward therefrom, and lateral side wing parts at opposite sides of the upstanding back portion extending forwardly therefrom to prevent excessive side to side movement of a person sitting therein.

In another exemplary embodiment of the invention, the seat shell includes one or more flexible adjusting straps for pulling the top segment of the upper part downward relative to the seat portion to selectively adjust the height thereof and modify the shape of the top segment for proper support of the person's head and neck. The top segment may have a series of horizontal grooves defined on its rear surface to control the amount of roll.

In a preferred embodiment of the invention, the seat shell has flexible internal straps and external straps to distribute pressure created by the adjusting straps and prevent tearing of the resilient shell material.

A feature of the invention is that the seat shell enables a person to be comfortable while in a sitting or upright position without physically restraining the person by strapping him into the shell. The seat shell has front to back stability without the use of rigid structural support members to maintain a person in an upright position and prevent side to side movement. However, the seat shell does overly limit the person's movements during activity.

Further features of the invention are that the seat shell is lightweight, portable, foldable, water repellent, washable, and has a high coefficient of friction to minimize slipping. The shell is also easily and completely adjustable and reusable as a seat insert in chairs or sofas of differing design. In addition, the seat shell does not physically restrain the patient therein, but adequately provides varying support for any patient's head, upper and lower neck, or upper and lower back.

Another feature of the invention is that the number of pressure points is reduced because of the use of cushioning resilient material and non-rigid reinforcement effected by flexible internal and external straps and webbing.

BRIEF DESCRIPTION OF THE DRAWINGS

The details of construction and operation of the invention are more fully described with reference to the accompanying drawings which form a part hereof and in which like reference numerals refer to like numerals throughout.

In the drawings

DESCRIPTION OF THE PREFERRED EMBODIMENTS

Figure 1:
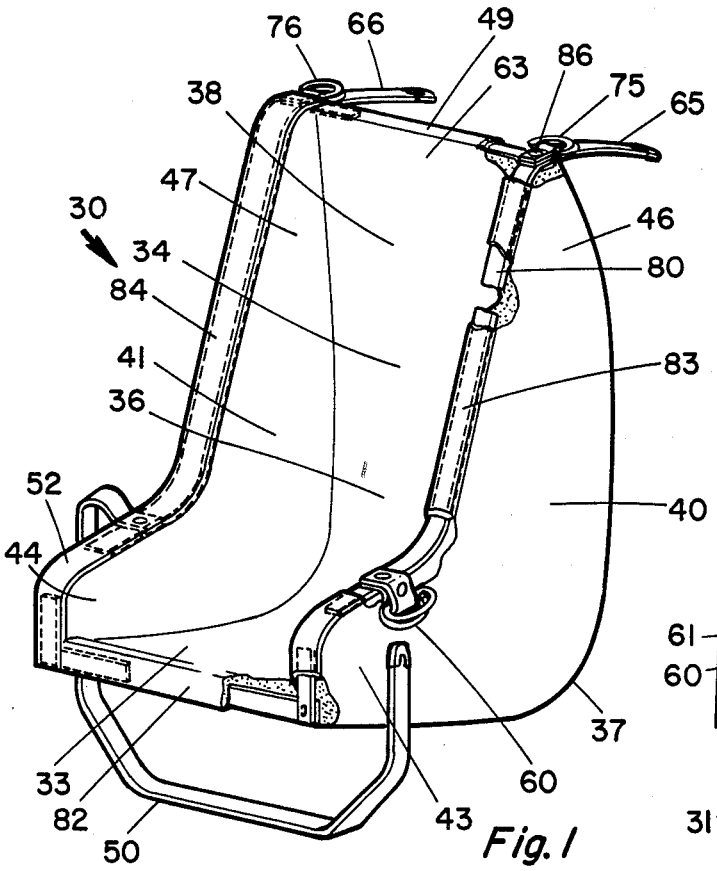
FIG. 1 is a front perspective view of a first embodiment of a posture alignment seat shell constructed in accordance with the present invention.

Best Modes for Carrying Out the Invention

A. Basic Seat Shell

Referring to FIGS. 1 through 4 of the drawings, a first embodiment of a posture alignment seat shell, generally designated 30, adapted for use in a conventional chair 31 includes a horizontal seat portion 33 and an upstanding back portion 34. The flat seat portion 33 and the back portion 34 are formed from resilient material, such as polyurethane or polyethylene foam, approximately 1 to 2 inches thick. The outer surface of the seat shell 30 is coated or sealed to provide a water and odor barrier. This may be accomplished by the use of a material sold under the name Tuftane, which also provides a surface having a high coefficient of friction to prevent slipping.

The upstanding portion 34 includes a lower back part 36 connected to the seat portion 33 by a curvilinear intermediate section 37, an upper back part 38 above the lower back part 36 and slanting forwardly therefrom, and spaced side wing parts 40 and 41 at opposite lateral sides of the back portion 34. The side parts 40 and 41 extend forwardly and downwardly from the top of the back portion 34 to the front of the the seat portion 33. As shown herein, the seat and back portions 33 and 34, respectively, are formed from a single piece of material with the side parts 40 and 41 laminated or glued thereto. However, it is conceived that the resilient material can be worked so that the resilient portions of the entire seat shell 30 are integrally formed from a single piece of material. Exposed edges and joints between the various parts are reinforced by internal flexible straps or webbing strips as described hereinafter.

Figure 10:
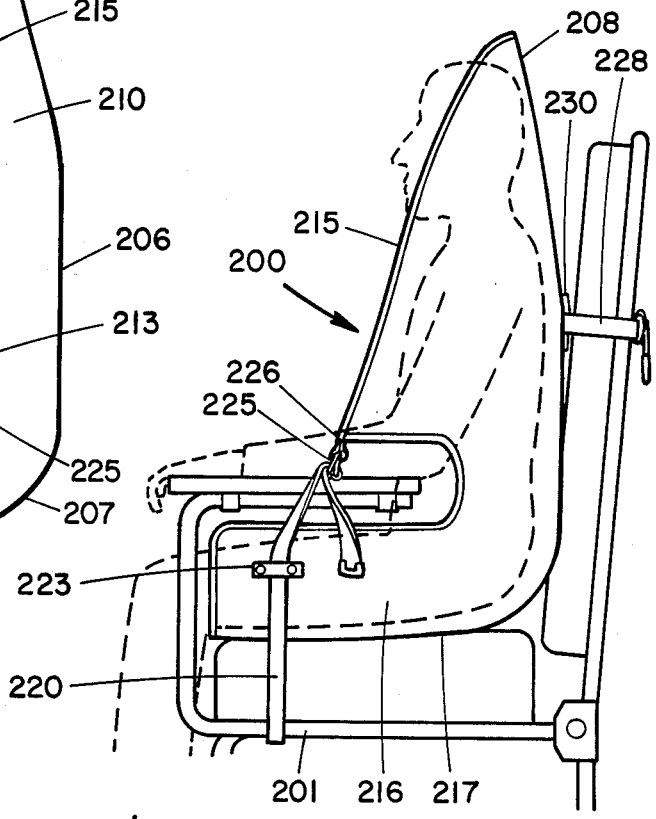
FIG. 10 is a side elevational view of the seat shell show in FIG. 9 showing a person using the seat shell in phantom and the seat shell mounted on a geriatric chair.

The forward slant of the upper back part 38 permits general alignment of the upper part 38 with the back of the user's head as illustrated in FIG. 10. The forward slant also resists backward motion of the upper back part 38 when a person leans back in the seat shell 30 thereby preventing the back portion 34 from folding or collapsing when slight rearward pressure is applied.

The side parts 40 and 41, which restrict side to side movement of a user, are generally L-shaped. The lower segments 43 and 44 of the respective side parts 40 and 41 may act as arm rests with the respective upper segments 46 and 47 tapering until joining with the top edge 49 of the upper back part 38.

Figure 2:
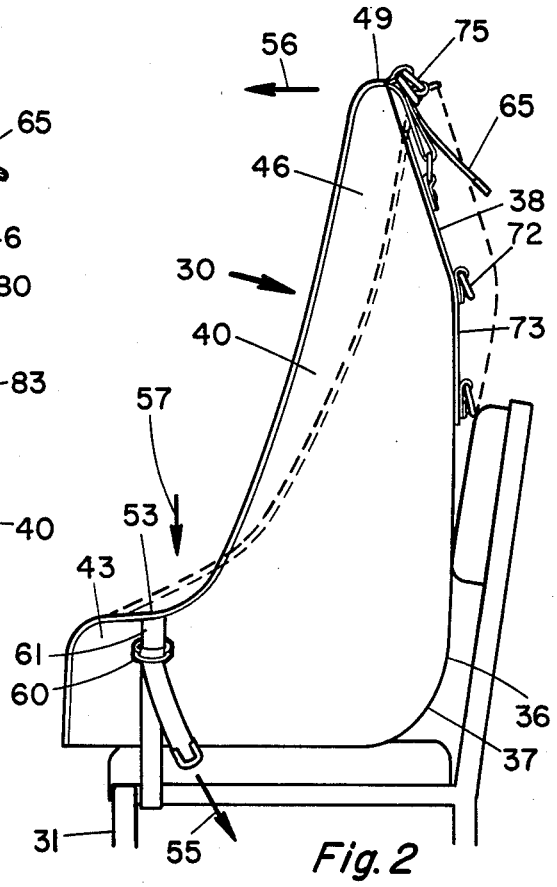
FIG. 2 is a side elevational view of the seat shell shown in FIG. 1 mounted on a conventional straight chair showing the unflexed condition of the seat shell in phantom.

As seen in FIGS. 1 and 2, an external flexible strap 50, which extends around the bottom of the chair 31, has one end attached adjacent the top edge 52 of the side part lower segment 44 at a location spaced from the front thereof and has its other end adjustably secured adjacent the top edge 53 of the opposite side part 43 so as to hold the entire seat shell 30 firmly on the chair 31. By adjusting the tightness of the strap 50 by pulling the strap downward as indicated by arrow 55 in FIG. 2, the angular position of the back portion 34 of the seat shell 30 can be moved forwardly from the position shown in phantom in FIG. 2 as indicated by arrow 56. The adjusting strap 50 provides continuous angular adjustment of the back portion 34 relative to the seat portion 33, the respective lower segments 43 and 44 of the side parts 40 and 41 being deformed by the pressure of the strap 50 as indicated by arrow 57 to bend the back of the seat shell 30. When the proper angular position of the back portion 34 is achieved the strap 50 is secured within the D-ring binding loops 60 held by the loop anchors 61 which in turn are fixed at the top edge 53 of the lower segment 43 of the side part 40.

Figure 3:
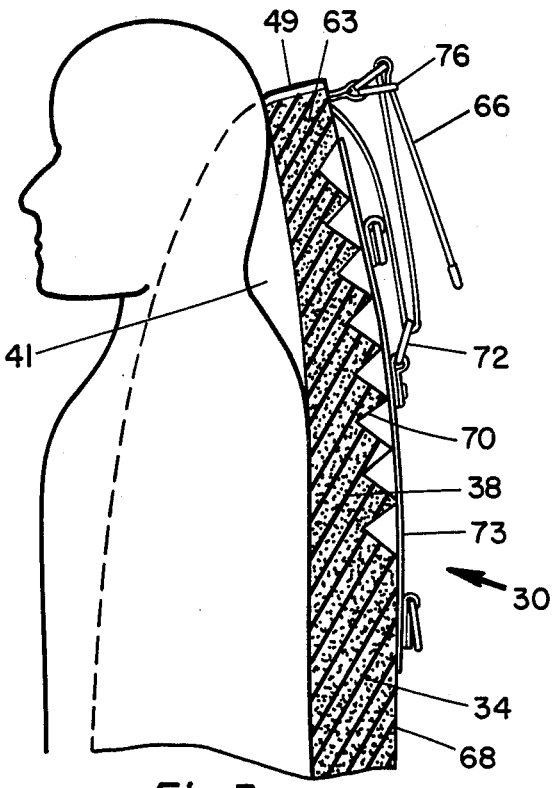
FIG. 3 is an enlarged, partial cross-sectional view of an upper portion of the seat shell taken along line 3—3 of FIG. 2 and showing a person using the seat shell.
Figure 4:
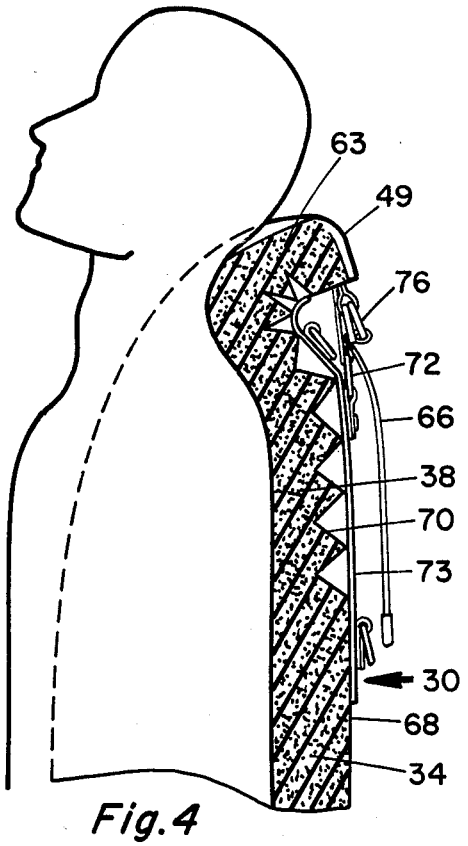
FIG. 4 is an enlarged, partial cross-sectional view of the seat shell of FIG. 3 with the upper portion of the seat shell being rolled and showing a person using the seat shell.
Figure 5:
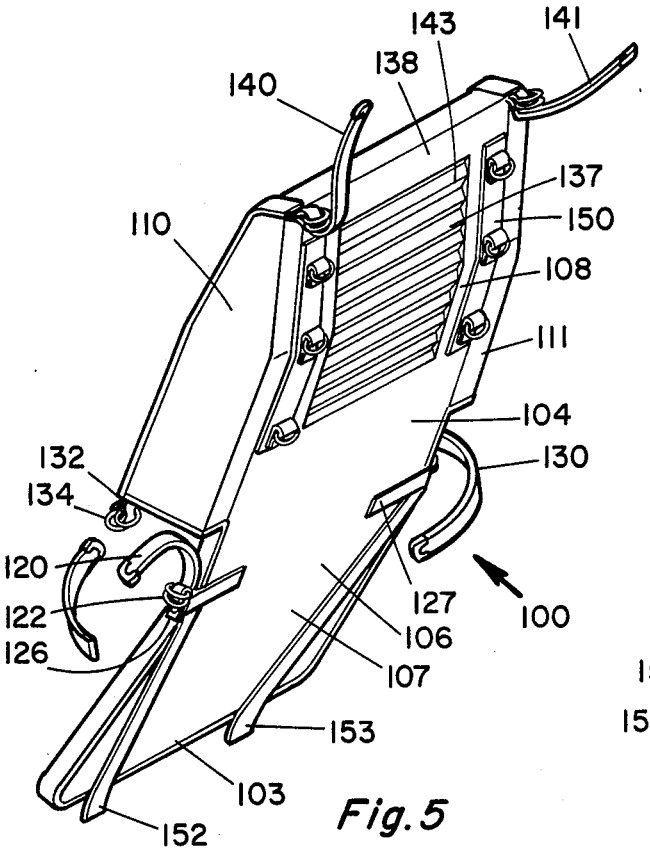
FIG. 5 is a rear perspective view of a second embodiment of a posture alignment seat shell constructed in accordance with the present invention.

To adjust the height and curvature of the top segment 63 of the upper back part 38, a pair of horizontally spaced, external top adjusting straps 65 and 66 are fixed adjacent opposite corners of the top edge 49. The top adjusting straps 65 and 66 extend between the top segment 63 and the back portion therebelow as seen in FIGS. 3 and 4. Defined in the back surface 68 of the upper back part 38 are a vertical series of horizontal grooves 70 permitting the resilient material to be deformed and rolled easily with an inward curl extending forwardly into contact with a user's neck (FIG. 4). By pulling the top adjusting straps 65 and 66 downwardly relative to the seat portion 33, the top segment 63 is pulled downward thereby permitting the height of the top segment 63 to be continuously adjusted to provide an adjustable cervical pillow for a person's head and neck.

For adjustably securing the top adjusting straps 65 and 66, two vertical series of D-ring loops 72 carried by a flexible strip 73 are located on the back surface 68 of the back portion 34, one on either side of the grooves 70. The straps 65 and 66 are inserted through one of the D-ring loops 72 and secured in the D-ring binding loops 75 and 76 fixed adjacent the corners of the top edge 49. By placing the top adjusting straps 65 and 66 through the higher loops, the height of the top segment roll will be high. By placing the straps 65 and 66 through the lower loops, the height of the roll will be low. The top straps 65 and 66 should be looped through the D-ring loop which provides the correct height for the user and the tightest roll so that the pillow does not collapse in use.

Since resilient foam has some structural rigidity, but does not have high tensile strength, internal reinforcing strips are fixed within the resilient material and the external straps are secured directly or indirectly thereto. The elongate strips are preferably made of polyurethane or nylon webbing. As best seen in FIG. 2 and also in FIG. 8, the internal strips 80 are positioned under the edges of the seat shell 30 along the front edge 82 of the seat portion 33, the front edges 83 and 84 of the respective side parts 40 and 41, and the top edge 49 of the upper back part 38. The strips 80 are sewn together at the corners or are joined by rivets or adhesive. As described hereinafter, the strips 80 are disposed beneath a thin layer of the resilient material so that the strips 80 are not felt by the user. The internal strips 80 distribute any pressure placed on particular points of the seat shell 30 over a large area thereby reducing pressure placed on a specific area by the adjusting straps and, resultingly, the probability of tearing the seat shell's resilient material.

Figure 8:
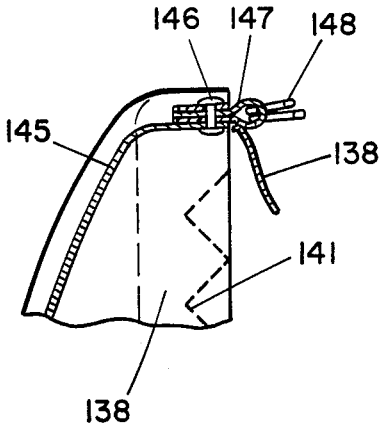
FIG. 8 is an enlarged, partial cross-sectional view of the upper portion of the seat shell.

In operation, stress created by the external top adjusting straps 65 and 66 is transferred to the long internal reinforcing strips 80 through the connecting rivet 86, or by a sewn joint, as best seen in FIGS. 1 and 8. Thus, no high stress is placed on any one point of the resilient material. Similarly, the external lower adjusting strap 50 is connected to the same internal reinforcing strip 80 which runs downward under the front edges 83 and 84 of the side parts 40 and 41.

B. Seat Shell for Wheel Chairs

Referring to FIGS. 5 through 8 of the drawings, a second embodiment of the seat shell, generally designated 100, adapted for use in a wheel chair 101 includes a seat portion 103 and a back portion 104 formed from resilient material and is constructed in a manner similar to the seat shell 30 shown in FIGS. 1 through 4. The back portion 104 includes a lower back part 106 connected to the flat seat portion 103 by an intermediate section 107, an upper back part 108 above the lower back part 106 and slanting forwardly therefrom, and spaced side wing parts 110 and 111 at opposite lateral sides of the back portion 104 and extending forwardly therefrom.

Figure 6:
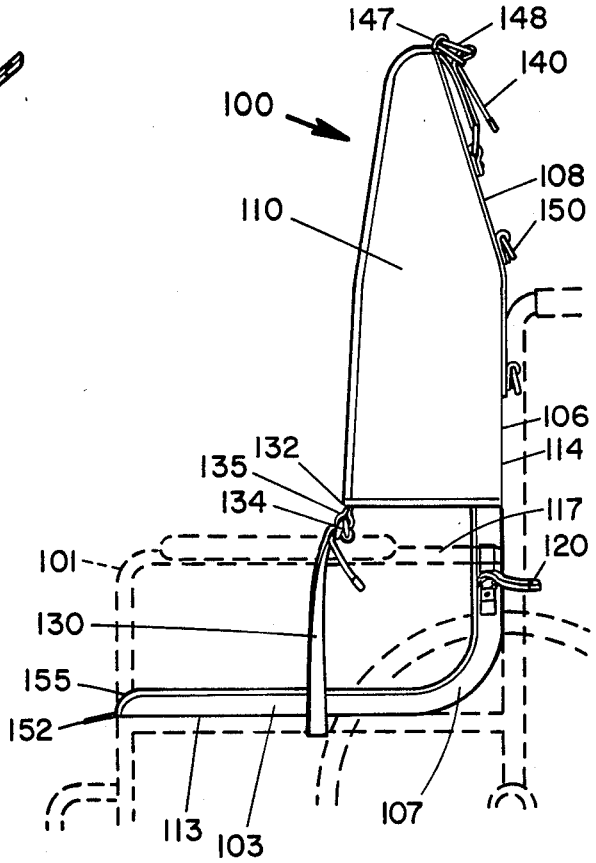
FIG. 6 is a side elevational view of the seat shell shown in FIG. 5 mounted on a conventional wheel chair, which is shown in phantom.
Figure 7:
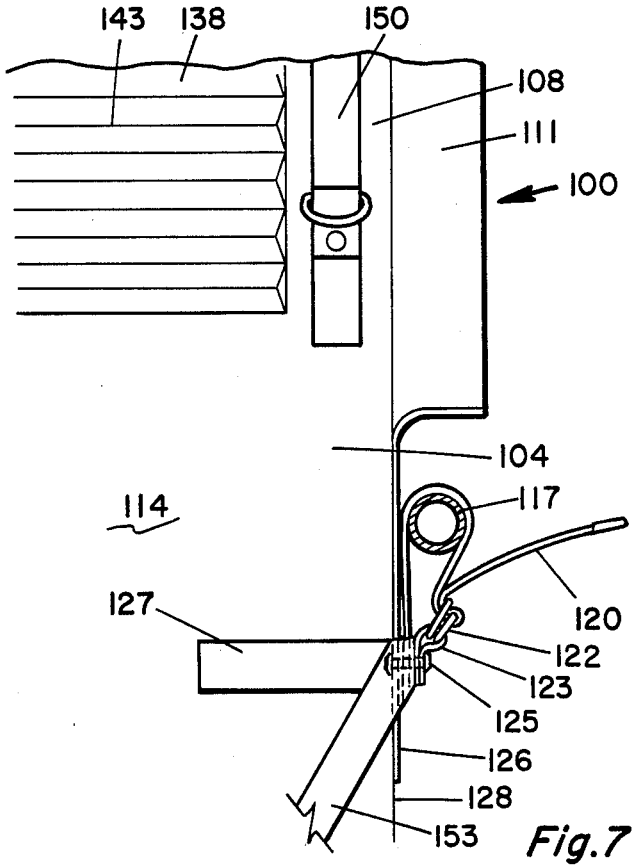
FIG. 7 is an enlarged, partial rear elevational view of the side midsection of the seat shell shown in FIG. 6.

As seen in FIGS. 6 and 7, the seat shell 100 is mounted in the wheel chair 101 by bending the intermediate section 107 in curvilinear fashion so that the bottom surface 113 of the horizontal seat portion 103 lies on the wheel chair seat and the rear surface 114 of the upstanding back portion 104 rests against the wheel chair back. The side parts 110 and 11 extend from the top downwardly and forwardly to a position in spaced relation from the seat portion 103 above the wheel chair arm bar 117. The seat shell 100 is secured to the spaced wheel chair arm bars 117 by flexible straps 120 having one end fixed to the side edge of the intermediate section 107 and its other end adjustably secured in the D-ring binding loops 122. Each of the flexible securing straps 120 and loop anchors 123 are fixed by a rivet 125 to reinforcing webbing straps 126 and 127 respectively extending along the exposed, narrow edge 128 of the intermediate section 107 and the back surface 114 of the back portion 104.

A back portion adjusting strap 130 extends between the forward lower edge of the side part 111 at one side around the seat portion 103 to the forward lower edge 132 of the opposite side part 110. The adjusting strap 130 also passes under the seat of the wheel chair 101. By adjusting the tightness of the adjusting strap 130, the angular position of the back portion 104 can be continuously adjusted relative to the seat portion 103 in a manner similar to that shown in FIGS. 1 through 4. When the back portion 104 is in proper position, the strap 130 is secured within the D-ring binding loops 134 held by the loop anchors 135 which in turn are fixed to the forward lower edge 132 of the respective seat shell side parts 110 and 111.

To adjust the height and curvature of the top segment 138 of the upper back part 108, a pair of external top adjusting straps 140 and 141 are positioned on either side of the horizontal grooves 143 and extend between the top segment 138 and the back portion therebelow. The top adjusting straps 140 and 141 each have one end secured to the edge reinforcing strip 145 by a rivet 146 which also fixes the anchor loops 147 of the D-ring binding loops 148. Each of the top adjusting straps are looped through one of the loops in its respective vertical D-ring strip 150 and secured in the binding loops 148 so that operation is similar to that shown in FIGS. 1 through 4.

To enable the seat shell 100 to be adjusted in the wheel chair 101 while in use, two external reinforcing straps 152 and 153 extend under the seat portion 103 and outwardly from the forward edge 155 approximately 3 or 4 inches. An attendant may pull on the straps 152 and 153 to pull the seat shell 100 forwardly or downwardly. By using these straps, the resilient material itself need not be pulled thereby minimizing the probability that the resilient material will be torn.

C. Seat Shell for Geriatric Chairs

Figure 9:
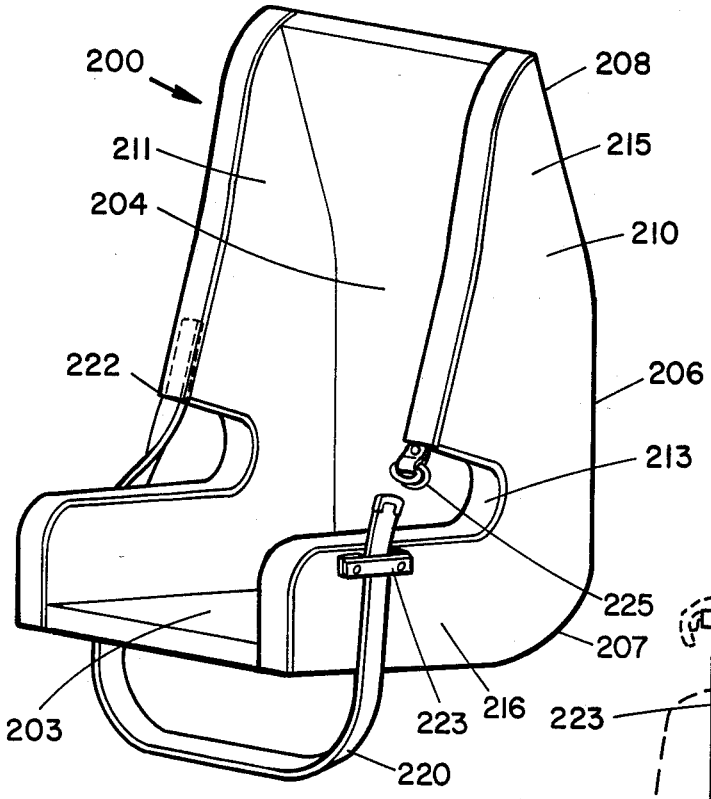
FIG. 9 is a front perspective view of a third embodiment of a posture alignment seat shell constructed in accordance with the present invention.
Figure 11:
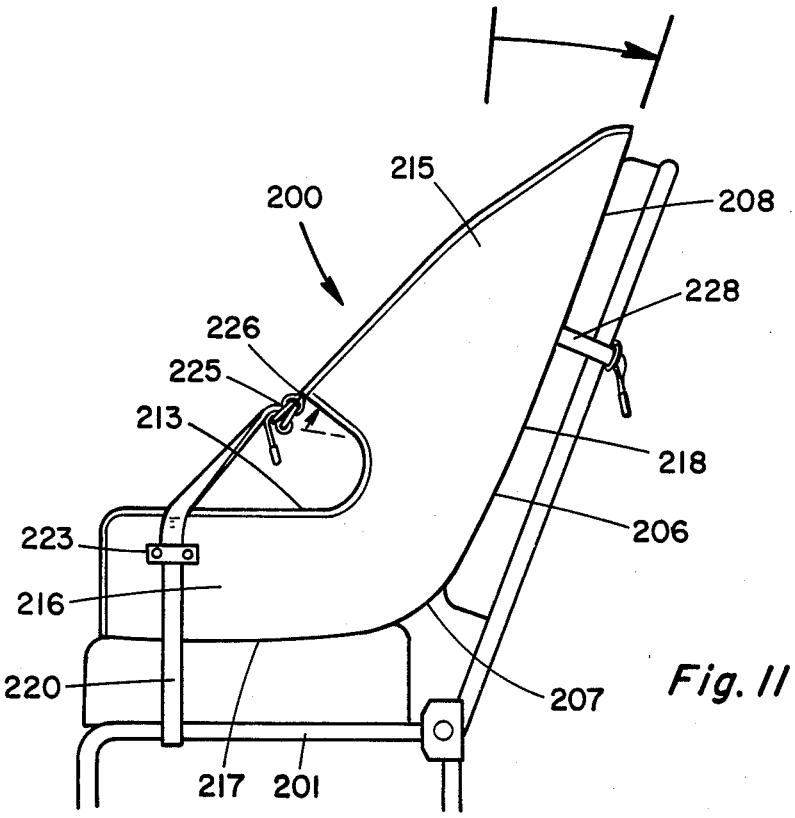
FIG. 11 is a side elevational view similar to FIG. 10 showing the chair and seat shell in a reclined position.

Referring to FIGS. 9 through 11 of the drawings, a third embodiment of the seat shell, generally designated 200, adapted for use in an adjustable geriatric chair 201 includes a horizontal, flat seat portion 203 and an upstanding back portion 204 formed from resilient material. The back portion 204 includes a lower back part 206 connected to the seat portion 203 by a curvilinear intermediate section 207, an upper back part 208 above the lower back part 206 and slanting forwardly therefrom, and spaced side wing parts 210 and 211 at opposite lateral sides of the back portion 204 and extending forwardly connecting the top of the back portion 204 and the front of the seat portion 203. Each of the side parts 210 and 211 has a slot 213 defined intermediate its upper and lower segments 215 and 216, respectively. The slot 213 has a forward opening above the seat portion 203 which extends rearwardly toward the back portion 204. The seat shell 200 also includes internal webbing reinforcement under its exposed, narrow edges in a manner previously described.

As seen in the drawings, the seat shell 200 is mounted in a geriatric chair 201 with the bottom surface 217 of the seat portion 203 lying on the geriatric chair seat and the rear surface 218 of the back portion 204 resting against the geriatric chair back. The seat shell 200 is secured to the chair seat by a lower adjusting strap 220 extending between the forward upper slot edge 222 on the side part 211 at one side through a loop (not shown) fixed to the outside of the side part 211 around the chair seat through a second loop 223 fixed to the outside of the lower side segment 216 to binding D-ring loops 225 at the forward upper slot edge 226 on the opposite side part 210. The use of the loops 223 renders the top portions of the seat shell 200 more stable and makes for a straighter strap angle from top to bottom. The back portion 204 of the seat shell 200 is secured to the movable chair back by a horizontal securing strap 228 that passes through a strap loop 230 fixed to the rear of the back portion 204 below the slanted upper back part 208 and is wrapped around the back of the geriatric chair 201.

The angular position of the back portion 204 of the seat shell 200 can be continuously adjusted relative to the seat portion 203 by adjusting the tightness of the lower strap 220 to pull the back part 208 forward. When the back of the geriatric chair 201 is lowered to a reclined position as seen in FIG. 11, the lower strap 220 can be loosened so that the angle of the upper part 208 of the back portion 204 can be adjusted relative to the lower part 206 which remains fixed to the chair back. The cutout slots 213 in the side parts 210 and 211 permit extreme bending of the seat shell 200. However, the benefit of the seat shell side parts is maintained throughout, since side movement of the user is still limited by the shell side parts. Further, a tray (not shown) may be placed on the chair and extend into the respective slots 213.

D. Reinforcing for Foam Shell

Figure 12:
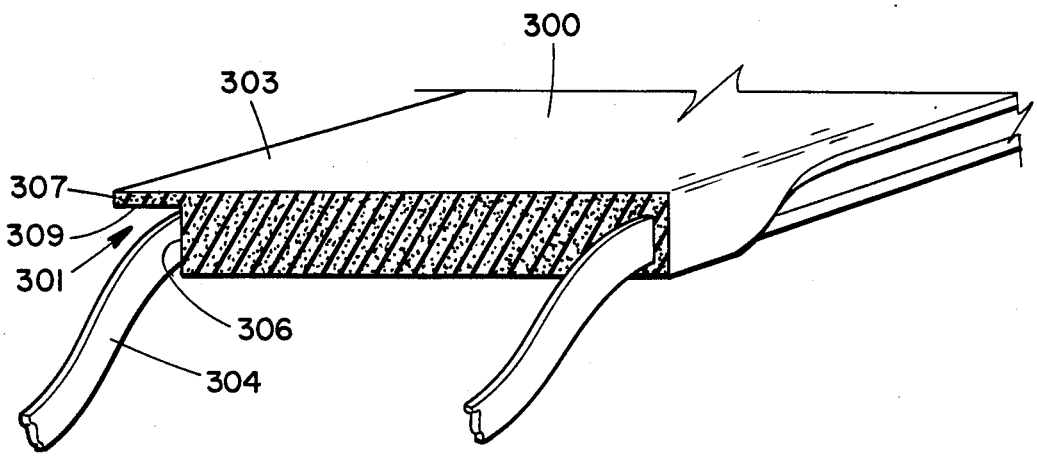
FIG. 12 is a partial cross-sectional view of the seat shell material showing the location of the internal reinforcing straps therein.
Figure 13:
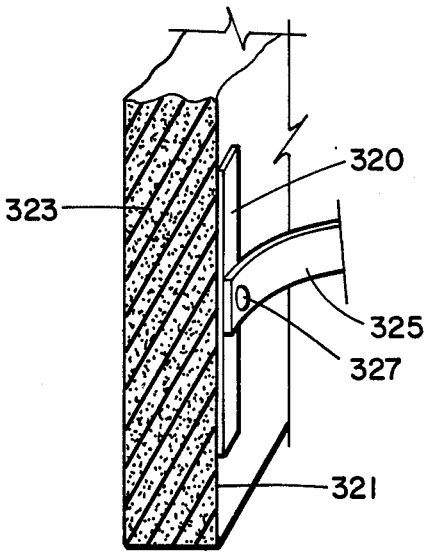
FIG. 13 is a partial cross-sectional view of the seat shell material showing a typical arrangement of the external adjusting reinforcing straps.
Figure 14:
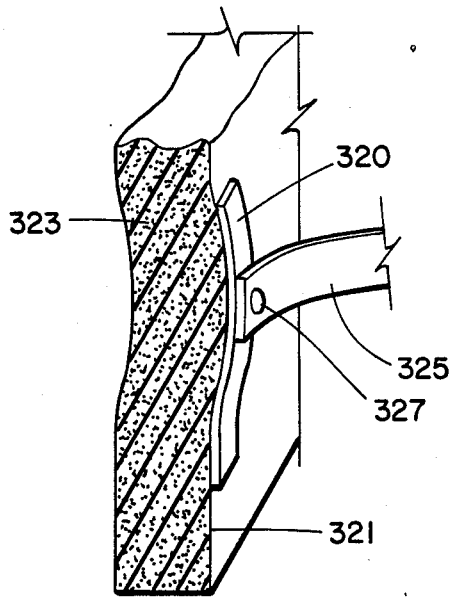
FIG. 14 is a partial cross-sectional view of the seat shell material similar to FIG. 13 showing the flexure of the seat shell material and reinforcing strap when the adjusting strap is pulled.

Referring to FIGS. 12 through 14 of the drawings, a simple method for internally and externally reinforcing the resilient foam shell material to extend its usable life is illustrated.

To provide for internal reinforcing of foam along an edge, the edge of a foam blank 300 is cut to provide a rectangular recess 301 under the top surface 303 as shown on the left side of the material in FIG. 12. A flexible strap 304, which may be made of nylon webbing, is then mounted to the inner edge 306 and the top layer 307 of the foam material is folded down over the strap 304 as shown on the right side of FIG. 12. The underside 309 of the top foam layer 307 is fixed to the strap 304 and the inner edge 306 of the foam by suitable means, such as adhesive or heat sealing.

If a strap is attached to resilient foam at a single point by a rivet, any great pressure tending to pull the strap away from the foam would tear the foam and destroy the connection between the strap and the foam. A simple method minimizing this problem by distributing pressure from a single point over a large area of resilient material such as plastic foam is shown in FIGS. 13 and 14. An elongate flexible webbing strap 320 is first attached to the outer surface 321 of the resilient foam blank 323 by suitable means, such as adhesive. The flexible adjusting or tension strap 325 to which a pulling force may be applied is fixed to this webbing strap 320 by a rivet 327 as shown, or by sewing, welding or other suitable means. When a force is exerted on the tension strap 325, the force is carried to the webbing strap 320, which distributes the force over an extended area of the resilient foam to deform a large portion of the foam as seen in FIG. 14. Since less force is exerted at any one point on the foam by this method, the tendency to tear the foam is reduced thereby extending the life of the article.

Industrial Applicability

From the foregoing, it should be apparent that the adjustable seat shell described herein is simple and inexpensive, yet provides a convenient and reliable means for supporting a person seated thereon.

Other aspects, objects and advantages of this invention can be obtained from a study of the drawings, the disclosure and the appended claims.

What is claimed is:

1. A seat shell for supporting a person seated thereon comprising:

a generally horizontal seat portion;

an upstanding back portion;

said seat portion and said back portion being formed from resilient material and defining an integral unit;

said upstanding back portion including a lower bakc part joining said upstanding back portion to the rear of said seat portion, an upper back part above said lower back part, and lateral side parts, one at opposite sides of said upstanding back portion and extending forwardly therefrom; and, adjusting strap means extending between said upper and lower back parts for pulling a top segment of said upper part downward relative to the remainder of the back portion to deform said upper back part into a head and neck support and for securing same in selected deformed position, whereby the height of the head and neck support is adjustable.

2. The seat shell of claim 1 wherein said seat shell is adapted to be mounted on a supporting chair and further including means for securing said shell to said chair, said chair securing means including at least one flexible strap securable to said seat shell and extending around a portion of said chair.

3. The seat shell of claim 1 wherein each of said side parts extends from the top of said upstanding back portion downwardly and forwardly to the front of said seat portion, and further including second adjusting strap means extending from one side part around the bottom of the seat shell to the opposite side part for pulling said upstanding back portion downward and forward relative to said seat portion and for securing same in angularly adjusted position.

4. The seat shell of claim 1 wherein each of said side parts extends from the top of said upstanding back portion downwardly and forwardly to a position in spaced relation from said seat portion, and further including second adjusting strap means extending from one side part around the bottom of the seat shell to the opposite side part for pulling said upstanding back portion downward relative to said seat portion and for securing same in angularly adjusted position.

5. The seat shell of claim 4 further including means on the lateral edges of said upstanding back portion for securing said seat shell to a wheel chair.

6. The seat shell of claim 5 wherein said wheel chair securing means comprises a flexible strap located under opposite side parts adapted to be secured to the arms of the wheel chair.

7. The seat shell of claim 1 wherein each of said side parts extends from the top of said upstanding back portion downwardly to the front of said seat portion and defines a cutout section along its forward edge at a position in spaced relation from said seat portion, and further including second adjusting strap means extending from one side part above said cutout section around the bottom the seat shell to the opposite side part above said cutout section for pulling said upstanding back portion downward relative to said seat portion and for securing same in angularly adjusted position.

8. The seat shell of claim 1 wherein the rear surface of said upper part of said shell defines grooves, said groove being generally horizontal and arranged in a generally vertical series, whereby tension of said adjusting strap means effects rolling of said resilient material adjacent said grooves.

9. The seat shell of claim 1 wherein said adjusting strap means includes at least one pair of spaced flexible straps extending from said top segment to a point on the rear surface of said back portion spaced downwardly from said top segment.

10. The seat shell of claim 9 further including releasable securing means comprising a plurality of loops arranged in at least one pair of spaced vertical series along said rear surface adapted to receive said flexible straps, whererby a flexible strap can be attached to any of said loops.

11. A seat shell for supporting a person seated thereon comprising:

a generally horizontal seat portion integrally joined to an upstanding back portion, said seat and back portions being formed from resilient material;

said upstanding back portion including a lower back part connecting said upstanding portion to said seat portion, an upper back part above said lower back part and slanting forwardly threfrom, and lateral side parts, one at opposite sides of said upstanding back portion and extending forwardly therefrom;

means for securing the seat shell to a chair or sofa;

adjusting strap means extending between said upper and lower back parts for pulling a top segment of said upper part downward relative to the remainder of the back portion to deform said upper back part into a head and neck support and for securing same in selected deformed position, whereby the height of the head and neck support is adjustable; and, second strap adjusting means for deforming said shell material by moving said upstanding back portion angularly relative to said seat portion and for securing same in selected angular position.

12. A seat shell for supporting a person seated thereon comprising:

a generally horizontal seat portion;

an upstanding back portion;

said seat portion and said back portion being integrally formed from resilient material and being adapted to be mounted on a supporting chair;

said upstanding portion including a lower back part connecting said upstanding back portion to the rear of said seat portion, an upper back part above said lower back part and slanting forwardly therefrom, and lateral side parts, one at opposite sides of said upstanding back portion and extending forwardly therefrom;

flexible means for securing said shell to the chair;

flexible adjusting means for deforming said shell material to move said upstanding back portion downward relative to said seat portion and securing same in selected angular position to provide support for a user's back;

second flexible adjusting means for deforming said shell material to move the top segment of said upper part downward relative to the seat portion to deform said upper back part and securing same in selected deformed position to provide support for a user's head or neck; and, flexible means located within said resilient material for internally reinforcing the seat shell, each of said adjusting means having at least one part secured to said internal reinforcing means.

13. The seat shell of claim 12 wherein said shell is free of rigid structural members.

* * * * *

UNITED STATES PATENT AND TRADEMARK OFFICE

CERTIFICATE OF CORRECTION

PATENT NO. : 4,673,213

DATED : Jun. 16, 1987

INVENTOR(S) : Richard D. Bushey et al.

It is certified that error appears in the above-identified patent and that said Letters Patent is hereby corrected as shown below:

In claim 1, column 7, line 58, change "bakc" to --back--.

In claim 8, column 8, line 48, change "tension" to --tensioning--.

In claim 10, column 8, line 60, change "whererby" to --whereby--.

In claim 11, column 9, line 2, change "threfrom" to --therefrom--.

Signed and Sealed this

Twenty-fourth Day of January, 1989

*Attest:*

DONALD J. QUIGG

*Attesting Officer*

*Commissioner of Patents and Trademarks*